US006425138B1

(12) United States Patent
Johnson

(10) Patent No.: US 6,425,138 B1
(45) Date of Patent: Jul. 30, 2002

(54) HOOD WITH SHOULDER SUPPORT

(76) Inventor: Cheryl E Johnson, 425 Portland Ave., Minneapolis, MN (US) 55488

( * ) Notice: Subject to any disclaimer, the term of this patent is extended or adjusted under 35 U.S.C. 154(b) by 0 days.

(21) Appl. No.: 09/637,533

(22) Filed: Aug. 11, 2000

(51) Int. Cl.[7] ..... A42B 1/04
(52) U.S. Cl. ..... 2/202
(58) Field of Search ..... 2/84, 85, 202–206

(56) References Cited

U.S. PATENT DOCUMENTS 2,686,317 A * 8/1954 Michaelis ..... 2/205
2,839,757 A * 6/1958 Gianola ..... 2/205
5,016,287 A * 5/1991 Harris ..... 2/202
5,274,850 A * 1/1994 Aldridge ..... 2/84
5,832,538 A * 11/1998 Williams ..... 2/202
5,873,132 A * 2/1999 Grilliot et al. ..... 2/84
6,006,360 A * 12/1999 Reed ..... 2/202

* cited by examiner

*Primary Examiner*—Peter Nerbun
*Assistant Examiner*—Katherine Moran
(74) *Attorney, Agent, or Firm*—Schwegman, Lundberg, Woessner & Kluth, P.A.

(57) ABSTRACT

The present invention includes a article of clothing. The article of clothing comprises a flexible main body, comprising a hood portion and a shoulder portion. The hood portion is attached to the shoulder portion. The shoulder portion comprises a pair of shoulder segments and a back segment. The shoulder segments are attachable to each other. The back segment is attached to each segment of the shoulder portion.

11 Claims, 3 Drawing Sheets

HOOD WITH SHOULDER SUPPORT

BACKGROUND OF THE INVENTION

The present invention relates to an article of clothing, a hood device, to a method for making a hood and to a kit for making a hood.

Articles of clothing that have hoods have typically had either attached hoods, integral with a garment such as a jacket or a coat or a cape or detachable hoods, typically detachable from a coat. Attached hoods, in some embodiments, have had a dramatic, theatrical, aesthetic effect, when worn. In other embodiments, however, hoods are a nuisance when not needed for protection from inclement weather and are unattractive.

Detachable hoods typically have functionality but no desirable aesthetics. Typically, detachable hoods are attached to a garment by button attachment mechanisms or zippers. Button attachment mechanisms define holes between the buttons. These holes are a source of drafts that chill the neck of an individual wearing a garment with a detachable hood.

Zipper attachment mechanisms tend to have openings on either side of a wearer's head. These openings also permit drafts to contact a wearer and to chill the wearer in cold or wet weather.

U.S. Pat. No. 5,845,340, which issued Dec. 8, 1998, describes a face and head protector garment for use against inclement weather. The garment includes a hood that covers the head and back area of the neck and a mask that fits over the head of the wearer. The mask defines openings for eyes, nose and mouth. The mask and hood function as a single unit.

SUMMARY OF THE INVENTION

In its product aspect, the present invention comprises an article of clothing. The article of clothing comprises a flexible main body. The flexible main body comprises a hood portion and a shoulder portion. The hood portion is attached to the shoulder portion. The shoulder portion comprises a pair of shoulder elements, attachable to each other and a back portion. The back portion is attached to each of the shoulder elements.

Another product aspect of the present invention comprises a kit for making a hood device. The kit comprises a template for a hood portion, a template for a first shoulder segment and a template for a second shoulder segment. The template for the second shoulder segment is a mirror image of the template for the first shoulder segment. The kit further comprises a template for a back segment.

A method aspect of the present invention comprises a method for making a hood device. The method comprises providing fabric and cutting the fabric to make hood segments. The fabric is also cut to make shoulder segments. The shoulder segments are mirror images of each other. The fabric is cut to make a back segment. The hood segments are attached to each other to make a hood portion. The back segment is attached to the hood portion. The shoulder segments are attached to the hood portion and the back segment.

DETAILED DESCRIPTION OF THE INVENTION

Figure 1:
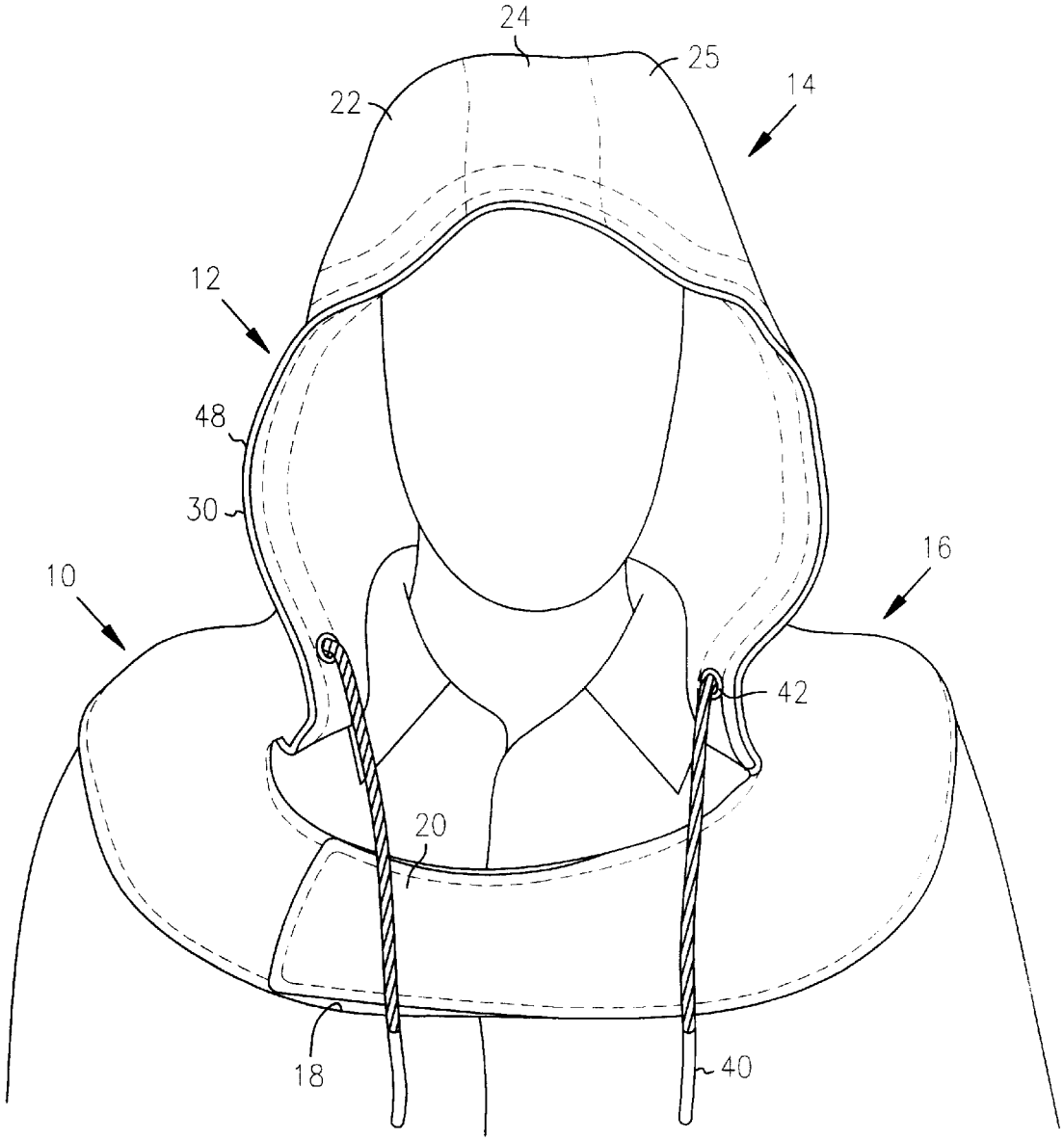
FIG. 1 illustrates a perspective view of one embodiment of the hood device of the present invention.

In its product aspect, one embodiment of the hood device of the present invention, illustrated generally at 10 in FIG. 1, comprises a main body 12 that includes a hood portion 14 and collar portion 16 attached to the hood portion 14. The collar portion 16 is of a shape that rests upon the shoulders of a user as shown in FIG. 1. The collar portion comprises an underlying end 18 and overlying end 20 that are attached to each other with an attachment mechanism, which is shown in FIG. 1. The attachment mechanism is a device such as a VELCRO® brand strip of hook and loop fasteners, or snaps, or buttons. The attachment mechanism is not shown in FIG. 1.

In one embodiment, illustrated at 10 in FIG. 1 the hood portion 14 comprises panels 22, 24, and 26. Panels 22 and 26 are substantially mirror images of each other. Panel 24 is a generally rectangular panel size to fit about the head of a user. In one embodiment, the fit is a loose fit wherein the hood portion 14 extends past the head of the user when in a used position as shown in FIG. 1.

In one embodiment, the hood device 10 is made with a double ply fabric arrangement, as shown in FIG. 1 at 28 and 30. With the double ply configuration, the hood device 10 may comprise an outer water repellant, wind repellant fabric and an inner, softer fabric. The double ply arrangement can also be used to impart the aesthetically best "lay" of the hood. By "lay" is meant that the hood acquires a desirable symmetry when covering the head of the wearer. In another embodiment, illustrated in FIG. 2, the hood device is made of only a single layer of fabric. This layer of fabric may be wind resistant and water repellant. The fabric may also be a soft, warm fabric such as wool or cashmere.

In one embodiment, the hood device 10 includes a tie 40 for positioning the hood closer to the head of the wearer. The tie 40 is positioned within a channel 42.

Figure 2:
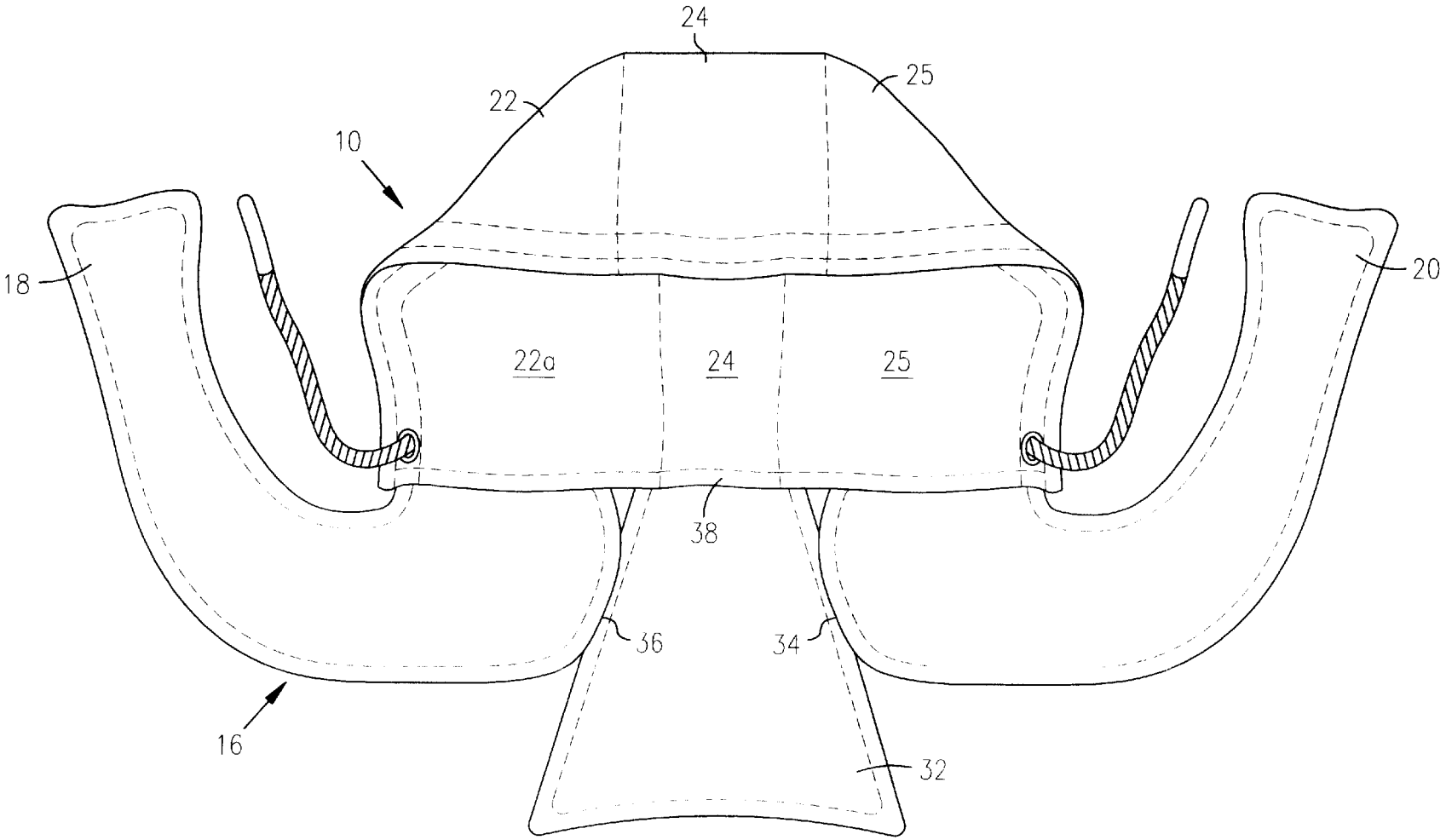
FIG. 2 illustrates a top plan view of one embodiment of the hood device of the present invention.

As illustrated in FIG. 2, the hood device 10 further comprises a back shoulder panel 32. The back shoulder panel is attached to the collar portions 18 and 20 at 34 and 36, respectively. The back shoulder panel 32 attachment is by a mechanism such as thread stitching. The back shoulder panel 32 is attached to the hood portion at 38. The back shoulder panel 32 not only stabilizes the hood device 10 when worn by a wearer but also protects the neck of the wearer against drafts, and rain, snow or sleet. The back shoulder portion 32 also keeps the wearer warm.

Figure 3:
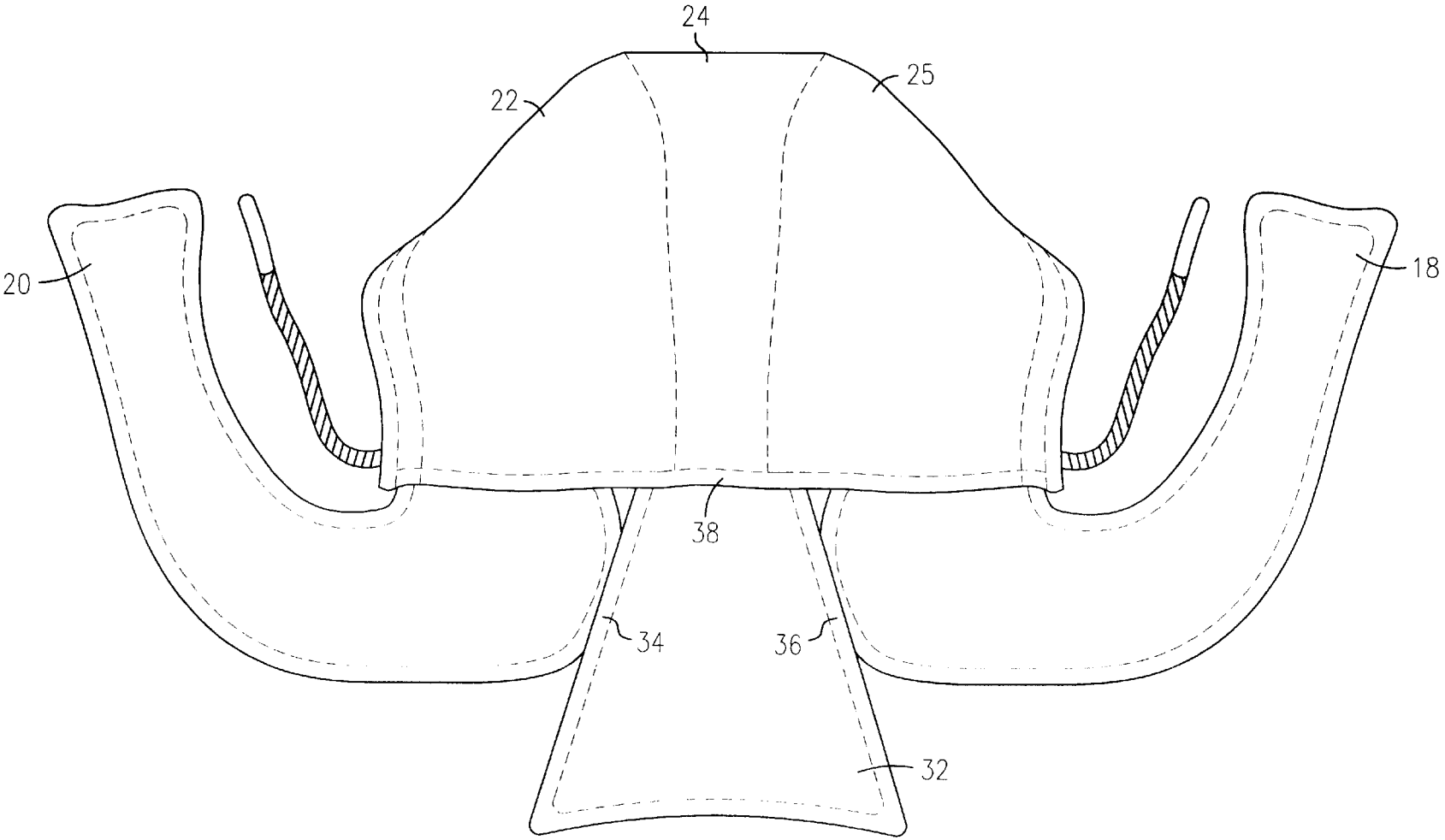
FIG. 3 illustrates a top plan view of a backside of the hood device of the present invention.

The back shoulder panel 32, shown in FIG. 3, is tapered so that the hood device 10 is securely held when positioned under a coat or jacket. The back shoulder panel 32 tapered shape also aids in reducing drafts. textile material such as a polyamide or an olefin blend, a viscose fiber, cotton, wool, silk or satin, polyethylene microfiber, polyethylene blend, polypropylene, velvet, nylon, velveteen, a polyethylene rayon blend, or other material. As discussed, the hood device 10 of the present invention may comprise a single fabric layer or may comprise a double fabric layer.

The hood device is made by separately cutting the components 18, 20, 32, 22, 24, and 25 from cloth. The cloth may be one ply. For some embodiments, the cloth comprises at least two-ply of the same type of cloth or different types of cloth. The components 22, 24 and 25 are sewn together as shown in FIGS. 1, 2 and 3 to make the hood portion. The back section 32 is sewn to the hood portion as shown in FIGS. 2 and 3. The shoulder segments 18 and 20 are sewn to the hood portion and the back portion 32 as is shown in FIGS. 2 and 3.

The components 18, 20, 32, 22, 24 and 25 are, in one embodiment, cut from pattern elements in a kit. Each pattern element provides a template for shaping each of the components. Each kit includes elements sized for particular types of wearers such as children and adults. Some kit embodiments include fabric.

Since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes, which come within the meaning and range of equivalency of the claims, are intended to be embraced therein.

What is claimed is:

1. An article of clothing, comprising:

a flexible main body, comprising a hood portion and a shoulder portion, the hood portion attached to the shoulder portion, the shoulder portion comprising a pair of shoulder segments and a back segment, the shoulder segments attachable to each other, and the back segment having a tapered shape with a narrow end and a wide end, the narrow end attached to the shoulder segments and the hood portion, and the wide end distal from the shoulder segments and hood portion, and the back segment extending below the shoulder segments so that the article of clothing is stabilized when worn by a wearer.

2. The article of clothing of claim 1 wherein the shoulder segments are attached to each other by a hook and loop strip positioned on at least one of the shoulder segments.

3. The article of clothing of claim 1 wherein the back segment is attached to each of the pair of shoulder segments by thread.

4. The article of clothing of claim 1 wherein the shoulder segments and back segment are attached to the hood by thread.

5. The article of clothing of claim 1 wherein the hood comprises a double ply material.

6. The article of clothing of claim 1 and further comprising a tie.

7. A kit for making a hood device, comprising:

a template for a hood portion;

a template for a first shoulder segment;

a template for a second shoulder segment, wherein the template is a mirror image of the template for the first shoulder segment; and a template for a back segment having a tapered shape with a narrow end and a wide end, and a sufficient length between the ends so that in a hood device made from the kit with the narrow end attached to the shoulder segments and the hood portion, and the wide end distal from the shoulder segments and hood portion, the back segment will extend below the shoulder segments.

8. The kit of claim 7 and further comprising a tie.

9. The kit of claim 7 and further comprising fabric for making the hood device.

10. A method for making a hood device, comprising:

providing fabric;

cutting the fabric to make hood segments;

cutting the fabric to make shoulder segments wherein the shoulder segments are mirror images of each other; and cutting the fabric to make a back segment wherein the back segment has a tapered shape with a narrow end and a wide end, and a sufficient length between the ends so that the back segment will extend below the shoulder segments in the hood device; and attaching the hood segments to each other to make a hood portion;

attaching the narrow end of the back segment to the hood portion; and attaching the shoulder segments to the hood portion and the narrow end of the back segment.

11. The method of claim 10 wherein the attaching is performed by sewing the segments.

* * * * *